United States Patent [19]

Barker

[11] Patent Number: 4,993,764

[45] Date of Patent: Feb. 19, 1991

[54] DOOR JAMB SECURITY APPARATUS

[76] Inventor: Rodney K. Barker, HC52 Box 2394-A, Bulverde, Tex. 78163

[21] Appl. No.: 317,019

[22] Filed: Feb. 28, 1989

Related U.S. Application Data

[63] Continuation-in-part of Ser. No. 93,306, Sep. 3, 1987, Pat. No. 4,862,658.

[51] Int. Cl.[5] ..... E05C 21/02; E06B 1/18

[52] U.S. Cl. ..... 292/340; 52/211; 52/217; 49/505

[58] Field of Search ..... 52/211, 217, 505; 292/340, 346; 49/504

[56] References Cited

U.S. PATENT DOCUMENTS

| | | | |
|---|---|---|---|
| 851,973 | 4/1907 | Aus . | |
| 1,179,597 | 4/1916 | Zahner . | |
| 1,193,812 | 8/1916 | Mulroy | 292/340 |
| 1,924,806 | 8/1933 | Saunders | 292/340 |
| 1,962,826 | 6/1934 | MacDonald . | |
| 2,804,182 | 8/1957 | Roos . | |
| 2,834,066 | 5/1958 | Lybarger . | |
| 2,893,070 | 7/1959 | Gauthier . | |
| 2,924,861 | 2/1960 | Viets . | |
| 3,248,833 | 5/1966 | Sklar . | |
| 3,425,159 | 2/1969 | Fortsch | 49/504 |
| 3,654,734 | 4/1972 | Lehman . | |
| 3,815,945 | 6/1974 | Lamphere | 292/340 |
| 3,906,671 | 9/1975 | Maldonado . | |
| 3,918,207 | 11/1975 | Aliotta | 49/462 |
| 3,938,291 | 2/1976 | Criswell . | |
| 4,015,382 | 4/1977 | Noyes . | |
| 4,057,275 | 11/1977 | LaBeaud | 49/504 |
| 4,251,962 | 2/1981 | Langenhorst . | |
| 4,416,087 | 11/1983 | Ghatak | 52/211 |
| 4,484,411 | 11/1984 | Rystad . | |
| 4,489,527 | 12/1984 | Haas . | |
| 4,571,995 | 3/1971 | Kasprzak . | |
| 4,684,160 | 8/1987 | Nelson | 292/340 |
| 4,717,185 | 1/1988 | Hartley . | |
| 4,865,370 | 9/1989 | Francis | 292/340 |

FOREIGN PATENT DOCUMENTS

| | | |
|---|---|---|
| 2265960 | 11/1975 | France . |
| 369276 | 6/1963 | Switzerland . |

*Primary Examiner*—John E. Murtagh

*Attorney, Agent, or Firm*—Richard J. Smith

[57] ABSTRACT

Door jamb lock side apparatus and door jamb header apparatus. The lock side apparatus comprises a metal jamb member connected to a wooden lock side member substantially flush therewith. The jamb member has a protruding portion which extends into a channel in the lock side member. A passage through the jamb member and a passage through the lock side member are aligned and adapted to receive the throw of a door lock. The header apparatus comprises a metal jamb piece connected to a wooden header member substantially flush therewith. The jamb member has a protruding portion which extends into a channel in the header member. The header apparatus may be used with double doors. A method of securing a door jamb is also disclosed.

2 Claims, 3 Drawing Sheets

DOOR JAMB SECURITY APPARATUS

This application is a continuation-in-part of U.S. patent application Ser. No. 093,306 filed Sept. 3, 1987, entitled Door Jamb Alignment and Security Apparatus, now U.S. Pat. No. 4,862,658 the disclosure of which is hereby incorporated by reference.

BACKGROUND OF THE INVENTION

The present invention relates to an apparatus for securing a locked door. More particularly, the present invention relates to door jamb apparatus which resists splitting and impedes dislodgment of a lock throw from the jamb.

Conventional wooden door framing generally comprises a hinge side cripple or door buck secured to an adjacent wall stud, a knob side cripple or door buck secured to an adjacent wall stud, and a frame header which extends across the tops of, and is connected to, the cripples. The door frame and floor supporting the frame define a door opening within which to receive a door jamb, to which a door is or may be connected. A conventional wooden door jamb comprises a hinge side adapted to be connected to the hinge side cripple, a knob side adapted to be connected to the knob side cripple, and a jamb header which extends between and is connected to the jamb sides on the uppermost ends thereof. When a locked door connected to a conventional wooden door jamb is kicked or pried, the conventional wooden door jamb has a tendency to split at the point at which the door lock throw penetrates the jamb. As such, conventional wooden door jambs provide little security against the unauthorized opening of the door by an intruder.

SUMMARY OF THE INVENTION

Accordingly, the present invention provides a lock or knob side of a door jamb which resists splitting and impedes dislodgment of a lock throw from the jamb. The present invention further provides jamb header apparatus for use with double doors which also resists splitting and impedes dislodgment of a lock throw therefrom. The present invention further provides a method for securing a door jamb.

The lock side apparatus of the present invention comprises a metal jamb member connected to a wooden lock side member. The jamb member comprises a protruding portion having a passage therethrough adapted to receive a lock throw therein. The lock side member has a channel therein within which to receive the protruding portion of the jamb member. The lock side member has a passage therethrough adapted to receive a lock throw therein. When the jamb member is connected to the lock side member, the jamb member passage is aligned with the lock side member passage. The lock side apparatus of the present invention may be connected to a jamb header and may form part of a door jamb.

The lock side apparatus is connected to a door frame such that the lock side member is intermediate to the jamb member and the door opening. Further, the lock throw of a door connected to the door jamb will extend through the lock side member passage and jamb member passage when the door is closed and locked. The metal jamb member provides added support to the wooden lock side member. Further, when the lock throw is received within the channel defined by the protruding portion, the lock side apparatus will impede dislodgment of the throw therefrom.

In one embodiment of the present invention, a planar metal plate is received within a groove or slot in a wooden lock side member. A lock throw passage through the plate is substantially aligned with a lock throw passage through the lock side member. The apparatus of the present invention may be utilized as a replacement for an existing lock side of a door jamb.

The jamb header apparatus of the present invention comprises a metal jamb piece connected to a wooden header member. The jamb piece comprises a protruding portion having a pair of passages therethrough, each of which are adapted to receive a lock throw therein. The header member has a channel therein within which to receive the protruding portion of the jamb piece. The header member has a pair of passages therethrough, each of which are adapted to receive a lock throw therein. When the jamb piece is connected to the header member, each of the jamb member passages is aligned with one of the header member passages. The jamb header apparatus of the present invention may be connected to jamb sides to form part of a door jamb.

The jamb header apparatus may form part of a door jamb such that the header member is intermediate to the jamb piece and the door opening. Further, each lock throw of a pair of doors connected to the door jamb will extend through a header member passage and jamb piece passage when the doors are closed and locked. The metal jamb piece provides added support to the wooden header member. Further, when the lock throws of the double doors are received within the channel defined by the protruding portion, the jamb header apparatus will impede dislodgment of the throws therefrom.

The method for securing a door jamb for a single door comprises the steps of removing the preexisting lock side of the door jamb, connecting a metal jamb member to a wooden lock side member to form a lock side apparatus, drilling a passage through the lock side apparatus, and connecting the lock side apparatus to the jamb header of the door jamb. The method for securing a door jamb for double doors comprises the steps of removing the preexisting jamb header of the door jamb, connecting a metal jamb piece to a wooden header member to form a jamb header apparatus, drilling a pair of passages through the jamb header apparatus, and connecting the jamb header apparatus to opposite sides of the door jamb.

DETAILED DESCRIPTION OF THE PREFERRED EMBODIMENT

Figure 1:
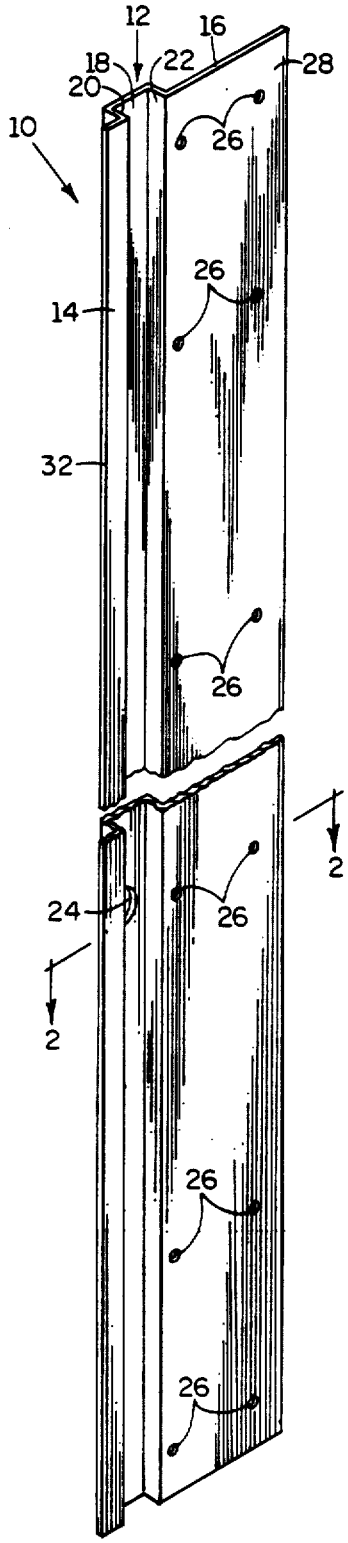
FIG. 1 is a broken perspective view of the preferred embodiment of a jamb member of the present invention.
Figure 2:
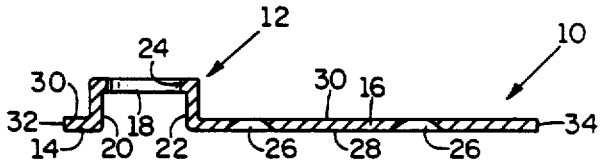
FIG. 2 is a cross sectional view of the preferred embodiment of a jamb member of the present invention taken along section lines 2—2 of FIG. 1.

Referring to FIG. 1 and FIG. 2, a jamb member of the present invention is identified by the number 10. Jamb member 10 preferably comprises a unitary piece of extruded aluminum having a protruding portion 12, a first plate portion 14 on one side of the protruding portion 12 and a second portion 16 on the opposite side of protruding portion 12. Plate portions 14 and 16 are substantially planar and are in substantially the same plane. Plate portions 14 and 16 extend from each side of protruding portion 12. Protruding portion 12 defines a channel having a bottom 18 and a pair of opposed side walls 20 and 22. A passage 24 adapted to receive a lock throw therethrough extends through bottom 18. Plate portion 16 has a plurality of countersunk screw holes 26 extending therethrough. Jamb member 10 has a front side or surface 28 and a rear side or surface 30. Jamb member 10 also has a first side edge 32 and a second side edge 34. Side wall 20 is substantially perpendicular to plate portion 14 and bottom 18, side wall 22 is substantially perpendicular to plate portion 16 and bottom 18, and bottom 18 is substantially parallel to plate portions 14 and 16.

Figure 4:
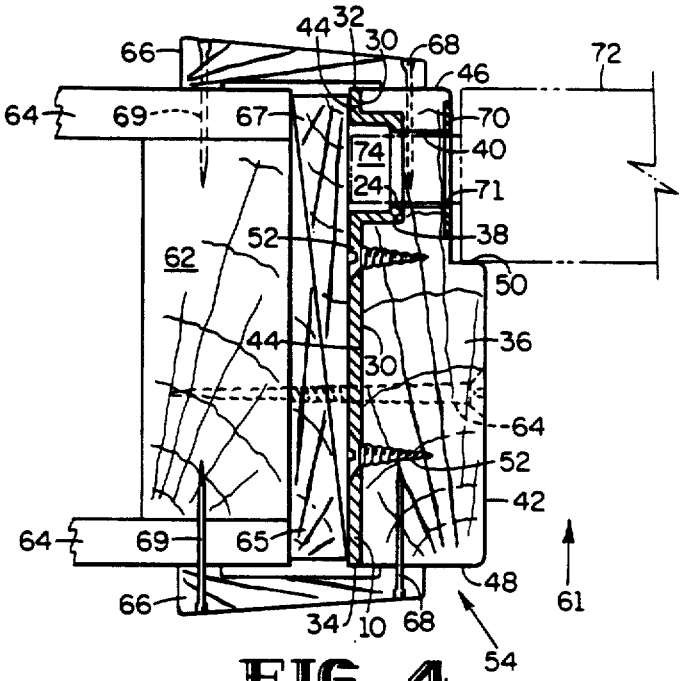
FIG. 4 is a cross sectional view illustrating the preferred embodiment of the lock side apparatus of the present invention secured to door framing.
Figure 3:
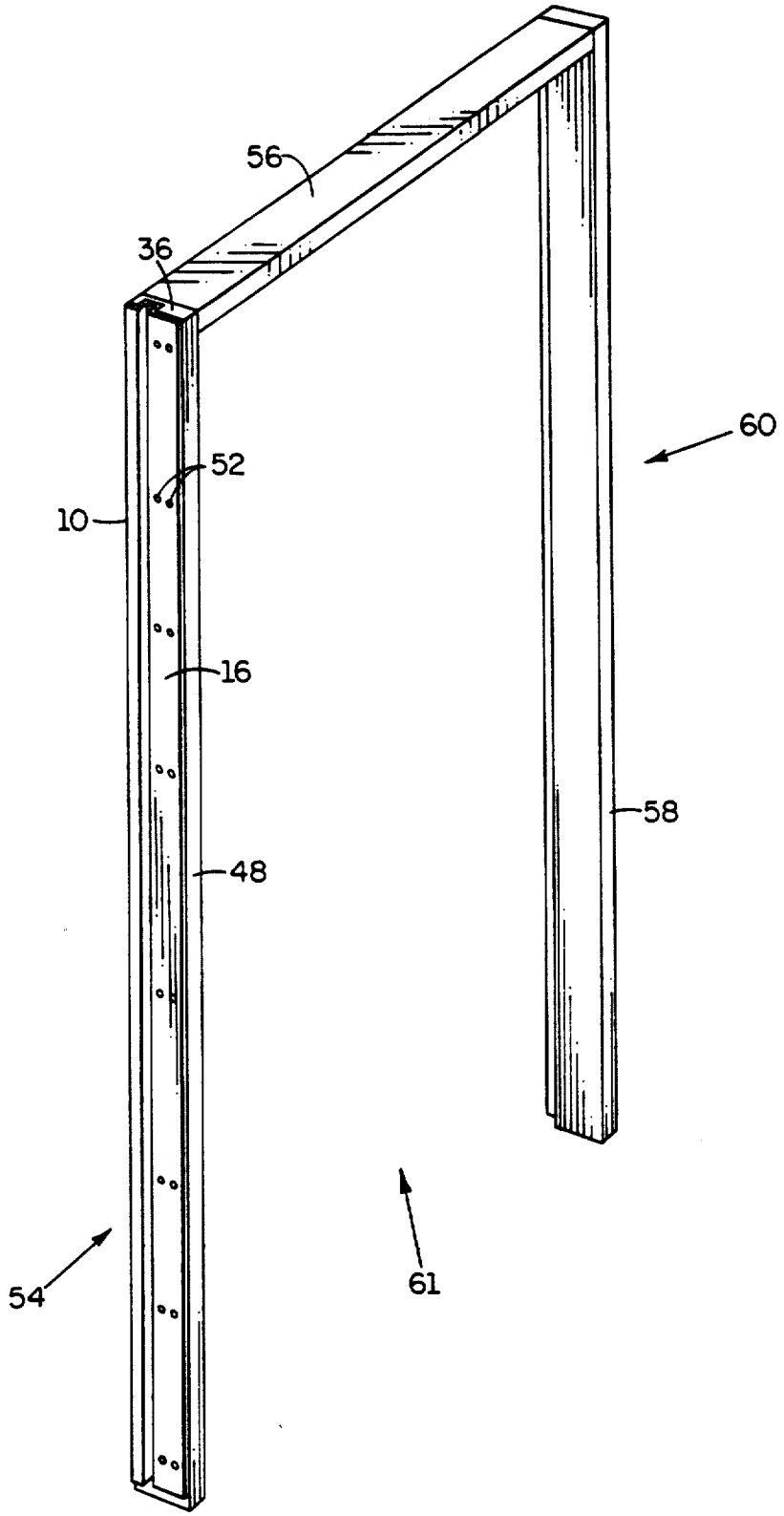
FIG. 3 is a perspective view of a door jamb assembly incorporating the lock side apparatus of the present invention.

Referring to FIG. 3 and FIG. 4, jamb member 10 is adapted to be connected to a wooden lock side member 36. Lock side member 36 has a channel or groove 38 therein and a lock throw passage 40 therethrough. Channel 38 extends substantially the entire length of lock side member 36 and is adapted to receive protruding portion 12 therein in mating engagement therewith. Lock side member 36 has an "out" side or surface 42 and an "in" side or surface 44. Lock side member 36 has a first side edge 46, a second side edge 48, and an inner edge 50 which is adapted to serve as a doorstop. Jamb member 10 is connected to lock side member 36 by inserting protruding portion 12 into channel 38 and screwing wood screws 52 into lock side member 36 through countersunk holes 26. Jamb member 10 may be further secured to lock side member 36 by an appropriate adhesive. When jamb member 10 is connected to lock side member 36, surface 30 is substantially flush with surface 44, side edge 32 is substantially aligned with side edge 46, and side edge 34 is substantially aligned with side edge 48.

Referring again to FIG. 3 and FIG. 4, jamb member 10 connected to lock side member 36 forms a lock or knob side apparatus 54. As illustrated in FIG. 3, the top or uppermost end of lock side apparatus 54 may be connected to a wooden jamb header 56. Jamb header 56 extends between, and is nailed or otherwise appropriately connected to, lock side member 36 and a wooden hinge side member 58 opposite lock side apparatus 54. That is, one end of jamb header 56 is connected to the uppermost end of lock side member 36 and the opposite end of jamb header 56 is connected to the uppermost end of hinge side member 58. Lock side apparatus 54, jamb header 56, and hinge side member 58 form a door jamb 60 adapted to be received within a door frame. Further, a door may be connected to jamb 60 so as to be received within door opening 61 intermediate lock side apparatus 54 and hinge member 58. As illustrated in FIG. 3, jamb member 10 extends substantially the entire length of lock side member 36 and substantially the entire height of door opening 61.

Referring to FIG. 4, the lock side apparatus 54 may be connected to the lock side door buck or cripple 62 of a door frame by means of a plurality of self tapping screws 64 which are driven through lock side member 36 and plate portion 16 along the length of apparatus 54 and into lock side door buck 62. A pair of shim pieces 65 and 67 may be inserted between apparatus 54 and lock side door buck or cripple 62 at approximately the level or height of passage 24 and, in such event, one or more screws 64 will also extend through shim pieces 65 and 67. Shim pieces 65 and 67 are preferably pieces of wood which are utilized to bridge a space or gap, if any, between jamb member 10 and door buck 62. Lock side door buck 62 is connected to an adjacent wall stud (not shown). Further, panelling or drywall material 64 may be appropriately secured to door buck 62. Finally, trim material 66 may be appropriately secured to lock side apparatus 54 and door buck 62. Each piece of trim material 66 is secured to lock side apparatus 54 by a plurality of nails 68 which extend through the respective trim piece 66 into lock side member 36 along the length of the respective trim piece 66. Each piece of trim material 66 is secured to door buck 62 by a plurality of nails 69 which extend through the respective trim piece 66 and the adjacent panelling 64 and into door buck 62 along the length of the respective trim piece 66. A standard keeper 70 having a passage 71 therethrough may be connected to lock side member 36 by screws (not shown) which extend into member 36 above and below passage 40.

It is to be understood that when lock side apparatus 54 is connected to door buck 62, lock side member 36 will be intermediate to door opening 61 and jamb member 10, as illustrated in FIG. 4. It is also to be understood that protruding portion 12 protrudes inward from plate portions 14 and 16 into groove 38 toward door opening 61 adjacent to member 36. Further, it is to be understood that passages 24 and 40 may be drilled in jamb member 10 and lock side member 36, respectively, prior to connecting jamb member 10 to lock side member 36. Alternatively, passages 24 and 40 may be drilled after jamb member 10 is connected to lock side member 36. Passages 24 and 40 are substantially aligned so as to provide a continuous passage through apparatus 54. Further, when a door 72 is closed and locked within door opening 61, the throw 74 of the lock associated with door 72 will extend through passage 40 and passage 24 and be received within the channel defined by protruding portion 12. Throw 74 extends through aligned passages 40 and 24 substantially perpendicular to plate portions 14 and 16. The inward protrusion of protruding portion 12 allows a greater portion of throw 74 to extend through jamb member 10. In the event door 72 is kicked or pried, lock side member 36 and lock side apparatus 54 will resist splitting and jamb member 10 and lock side apparatus 54 will impede dislodgment of throw 74 from lock side apparatus 54. If a keeper 70 is connected to member 36, keeper passage 71 will be aligned with passages 40 and 24, throw 74 will extend through passage 71 in addition to passages 40 and 24, and keeper 70 will provide additional security against the dislodgment of throw 74 from apparatus 54. Finally, it is to be understood that when lock side apparatus 54 is connected to door buck 62, jamb member 10 will be substantially concealed when lock side apparatus 54 is viewed from door opening 61.

Figure 5:
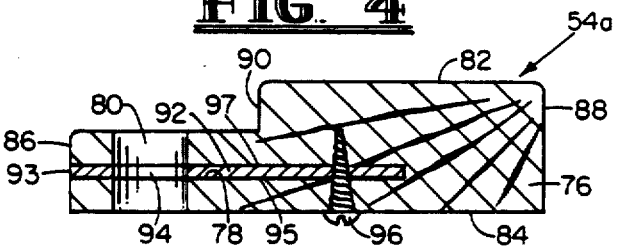
FIG. 5 is a cross sectional view of an alternate embodiment of the lock side apparatus of the present invention.

Referring to FIG. 5, an alternate embodiment of a knob or lock side apparatus is identified by the number 54a. Lock side apparatus 54a comprises a wooden lock side member 76 having a slot 78 therein and a passage 80 therethrough. Lock side apparatus 54a has an "out" side or surface 82 and an "in" side or surface 84. Lock side apparatus 54a has a first side edge 86, a second side edge 88, and an inner edge 90 which is adapted to serve as a doorstop. Slot 78 extends from side edge 86 into lock side member 76 a distance approximately equivalent to three fourths (¾) of the width of lock side member 76 between edge 86 and edge 88. Slot 78 is substantially transverse to passage 80.

Referring again to FIG. 5, a substantially planar plate 92 having a passage 94 therethrough is received within slot 78 such that the outer edge 93 of plate 92 is substantially aligned with side edge 86 and plate 92 is substantially concealed within lock side member 76. Plate 92 extends substantially the entire of lock side member 76 and is received within slot 78 in a press fit. Plate 92 comprises a unitary piece of extruded aluminum and is connected to lock side member 76 by a plurality of screws 96 which extend into lock side member 76 and through plate 92 along the length of plate 92 substantially transverse to plate 92. Opposite sides 95 and 97 of plate 92 are preferably serrated and plate 92 may be further secured to lock side member 76 by an appropriate adhesive. Lock side apparatus 54a may be connected to a lock side door buck 62 in the manner as described in connection with lock side apparatus 54 with screws 64 extending through plate 92. A keeper 70 may be connected to apparatus 54a in the manner as described in connection with apparatus 54 by screws which extend into member 76 above and below passage 80. Further, lock side apparatus 54a may be part of a door jamb having one end of a jamb header 56 nailed or otherwise connected to lock side member 76 and the opposite end of the jamb header 56 nailed or otherwise connected to a hinge side member 58. Passages 80 and 94 may be drilled in lock side member 76 and plate 92, respectively, before or after plate 92 is inserted into slot 78. Passages 80 and 94 are substantially aligned so as to provide a continuous passage through apparatus 54a and are adapted to receive a lock throw 74 therein substantially perpendicular to plate 92. Lock side apparatus 54a will resist splitting and impede dislodgment of throw 74 therefrom in the event door 72 is kicked or pried. If a keeper 70 is connected to member 76, keeper passage 71 will be aligned with passages 80 and 94, throw 74 will extend through passage 71 in addition to passages 80 and 94, and keeper 70 will provide additional security against the dislodgment of throw 74 from apparatus 54a.

Figure 6:
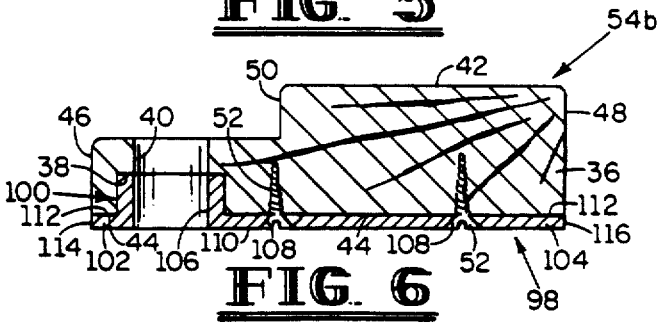
FIG. 6 is a cross sectional view of a further embodiment of the lock side apparatus of the present invention.

Referring to FIG. 6, another embodiment of a knob or lock side apparatus is identified by the number 54b, with like numbers being utilized components identical to lock side apparatus 54. Lock side apparatus 54b comprises a jamb member 98 connected to a wooden lock side member 36. Jamb member 98 preferably comprises a unitary price of extruded aluminum having a protruding portion 100, a first plate portion 102 on one side of the protruding portion 100 and a second plate portion 104 on the opposite side of protruding portion 100. Plate portions 102 and 104 are substantially planar and are in substantially the same plane. Plate portions 102 and 104 extend from each side of protruding portion 100. A passage 106 adapted to receive a lock throw therethrough extends through protruding portion 100. Protruding portion 100 is solid except for passage 106 therethrough. Protruding portion 100 and passage 106 are substantially transverse to plate portions 102 and 104. Plate portion 104 has a plurality of countersunk screw holes 108 extending therethrough. Jamb member 98 has a front side or surface 110 and a rear side or surface 112. Jamb member 98 also has a first side edge 114 and a second side edge 116.

Referring again to FIG. 6, jamb member 98 is adapted to be connected to wooden lock side member 36. Jamb member 98 is connected to lock side member 36 by inserting protruding portion 100 into channel 38 and screwing wood screws 52 into lock side member 36 through countersunk holes 108. Jamb member 98 may be further secured to lock side member 36 by an appropriate adhesive. When jamb member 98 is connected to lock side member 36, surface 112 is substantially flush with surface 44, side edge 114 is substantially aligned with side edge 46, and side edge 116 is substantially aligned with side edge 48. Jamb member 98 preferably extends the entire length of lock side member 36. Lock side apparatus 54b may be connected to a lock side door buck 62 in the manner as described in connection with lock side apparatus 54 with screws 64 extending through plate portion 104. A keeper 70 may be connected to apparatus 54b in the same manner as described in connection with apparatus 54. Further, lock side apparatus 54b may be part of a door jamb having one end of a jamb header 56 nailed or otherwise connected to lock side member 36 and the opposite end of the jamb header 56 nailed or otherwise connected to a hinge side member 58. Passages 106 and 40 may be drilled in jamb member 98 and lock side member 36, respectively, before or after jamb member 98 is connected to lock side member 36. Passages 106 and 40 are substantially aligned so as to provide a continuous passage through apparatus 54b and are adapted to receive a lock throw 74 therein substantially perpendicular to plate portions 102 and 104. The inward protrusion of protruding portion 100 from plate portions 102 and 104 into groove 38 toward door opening 61 allows a greater portion of throw 74 to extend through jamb member 98. Further, in the event door 72 is kicked or pried, lock side member 36 and lock side apparatus 54b will resist splitting and jamb member 98 and lock side apparatus 54b will impede dislodgment of throw 74 from lock side apparatus 54b. If a keeper 70 is connected to member 36, keeper passage 71 will be aligned with passages 40 and 106, throw 74 will extend through passage 71 in addition to passages 40 and 106, and keeper 70 will provide additional security against the dislodgment of throw 74 from apparatus 54b. Finally, it is to be understood that when lock side apparatus 54b is connected to door buck 62, jamb member 98 will be substantially concealed when lock side apparatus 54b is viewed from door opening 61.

Jamb member 10 and jamb member 98 preferably have a length of approximately six feet eight inches (6'8") and a width from one side edge to the other side edge of approximately four and one half inches (4½"). Plate 92 and lock side member 76 preferably have a length of approximately six feet eight inches (6'8"). Plate portions 14 and 16 and bottom 18 preferably have a thickness of approximately three thirty seconds inch (3/32") and the width between side walls 20 and 22 is preferably approximately seven eighths inches (⅞").

Plate portions 102 and 104 preferably have a thickness of approximately three thirty seconds inch (3/32") and protruding portion 100 preferably has a thickness of approximately one half inch (½"). It is also to be understood that front sides 28 and 110 and rear sides 30 and 112 may be serrated. Further, it is to be understood that apparatus 54, 54*a*, and 54*b* may be nailed to door buck 62. Finally, it is to be understood that apparatus 54, 54*a* and 54*b* may be used in preexisting or new construction and are only used on the lock side of the door jamb.

Figure 7:
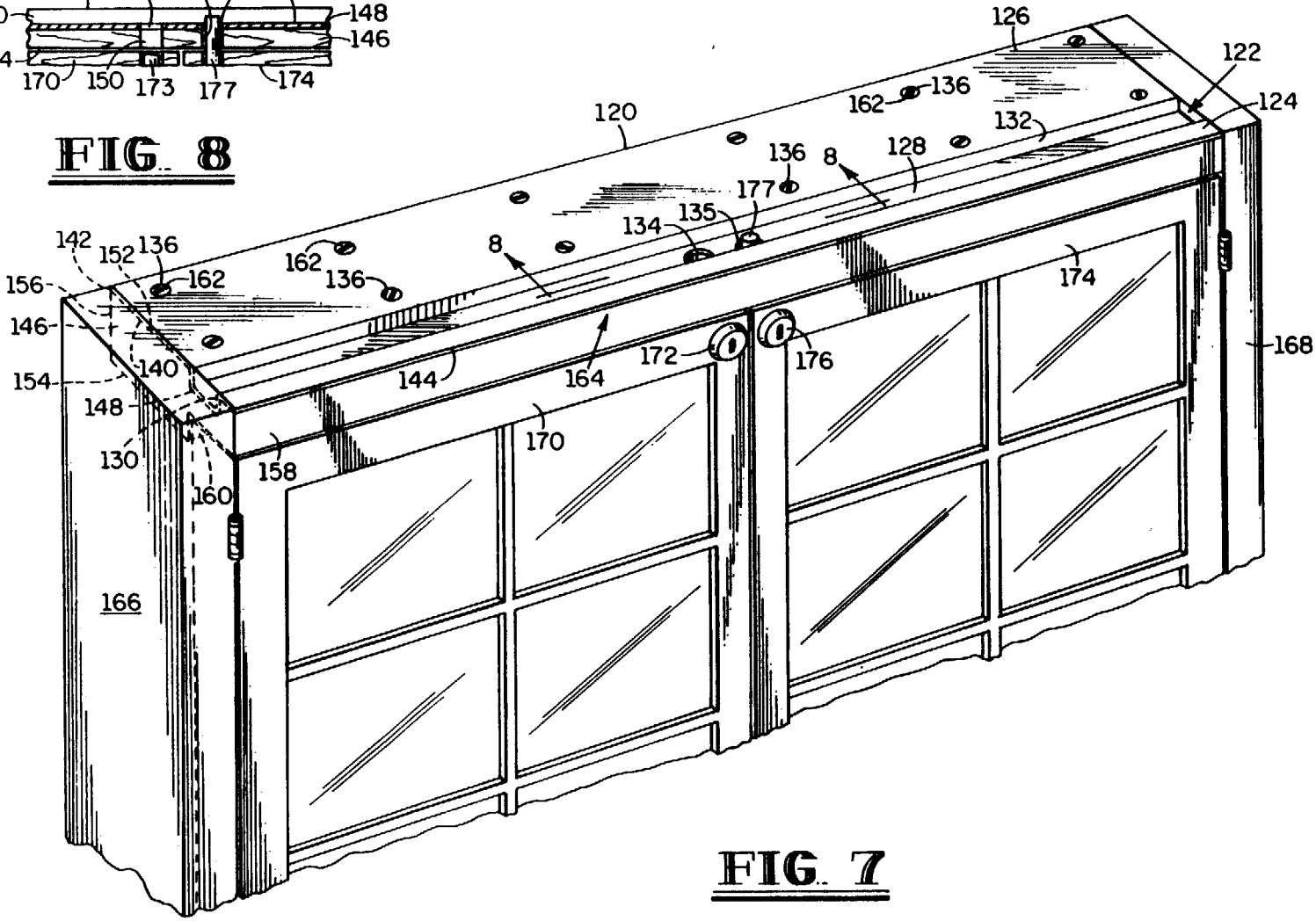
FIG. 7 is a perspective view of the jamb header apparatus of the present invention forming part of a door jamb.
Figure 8:
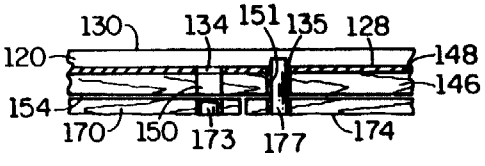
FIG. 8 is a partial cross sectional view taken along section lines 8—8 of FIG. 7 further illustrating the jamb header apparatus of the present invention.

Referring to FIG. 7 and FIG. 8, a jamb piece of the present invention is identified by the number 120. Jamb piece 120 preferably comprises a unitary piece of extruded aluminum having a protruding portion 122, a first plate portion 124 on one side of the protruding portion 122 and a second plate portion 126 on the opposite side of protruding portion 122. Plate portions 124 and 126 are substantially planar and are in substantially the same plane. Plate portions 124 and 126 extend from each side of protruding portion 122. Protruding portion 122 defines a channel having a bottom 128 and a pair of opposed sidewalls 130 and 132. A pair of passages 134 and 135, each of which are adapted to receive a lock throw therethrough, extend through bottom 128. Plate portion 126 has a plurality of countersunk screw holes 136 extending therethrough. Jamb member 120 has a front side or surface 138 and a rear side or surface 140. Jamb member 120 also has a first side edge 142 and a second side edge 144. Sidewall 130 is substantially perpendicular to plate portion 124 and bottom 128, side wall 132 is substantially perpendicular to plate portion 126 and bottom 128, and bottom 128 is substantially parallel to plate portions 124 and 126.

Referring again to FIG. 7 and FIG. 8, jamb piece 120 is adapted to be connected to a wooden header member 146. Header member 146 has a channel or groove 148 therein and a pair of lock throw passages 150 and 151 therethrough. Channel 148 extends the entire length of lock side member 146 and is adapted to receive protruding portion 122 therein in mating engagement therewith. Lock side member 146 has a "out" side or surface 152 and an "in" side or surface 154. Header member 146 has a first side edge 156, and a second side edge 158, and an inner edge 160 which is adapted to serve as a doorstop. Edge 160 extends the entire length of header member 146. Jamb member 120 is connected to header member 126 by inserting protruding portion 122 into channel 148 and screwing wood screws 162 into header member 146 through countersunk holes 136. Jamb member sides 138 and 140 may be serrated and jamb piece 120 may be further secured to header member 146 by an appropriate adhesive. When jamb piece 120 is connected to header member 146, surface 140 is substantially flush with surface 152, side edge 142 is substantially aligned with side edge 156, and side edge 144 is substantially aligned with side edge 158.

Referring again to FIG. 7 and FIG. 8, jamb piece 120 connected to header member 146 forms a jamb header apparatus 164. As illustrated in FIG. 7, apparatus 164 may form part of a door jamb to be utilized in connection with double doors. That is, jamb header apparatus 164 may extend between, and be nailed or otherwise appropriately connected to, a first side member 166 of a door jamb and a second side member 168 of a door jamb opposite jamb side 166. The uppermost end of first side member 166 is connected to one end of jamb header apparatus 164 and the uppermost end of second side member 168 is connected to the opposite end of jamb header apparatus 164. A first door 170 having a lock 172 may be hingedly connected to jamb side 166 and a second door 174 having a lock 176 may be hingedly connected to jamb side 168. As illustrated in FIG. 7 and FIG. 8, door 170 is closed and unlocked and door 174 is closed and locked. When doors 170 and 174 are closed and locked, lock throw 173 associated with lock 172 will extend through aligned passages 150 and 134 and lock throw 177 associated with lock 176 will extend through aligned passages 151 and 135. When door 170 is closed and locked, lock throw 173 will extend through aligned passages 150 and 134 substantially perpendicular to plate portions 124 and 126 and be received within the channel defined by protruding portion 122. Likewise, when door 174 is closed and locked, lock throw 177 will extend through aligned passages 151 and 135 substantially perpendicular to plate portions 124 and 126 and be received within the channel defined by protruding portion 122. In the event locked doors 170 and 172 are kicked or pried, header member 146 and jamb apparatus 164 will resist splitting and jamb member 120 and header apparatus 164 will impede dislodgment of throws 173 and 177 from header apparatus 164.

Referring again to FIG. 7 and FIG. 8, it is to be understood that jamb piece 120 extends substantially the entire length of header member 146 and substantially the entire width of the door opening within which doors 170 and 174 are received. Further, it is to be understood that when jamb header apparatus 164 is connected to jamb sides 166 and 168 so as to form a door jamb assembly, header member 146 will be intermediate to jamb piece 120 and the door opening defined by the door jamb assembly and jamb piece 120 will be substantially concealed when header apparatus 164 is viewed from such door opening. It is also to be understood that passages 134 and 135 may be drilled in jamb piece 120 prior to connecting jamb piece 120 to header member 146. Further, passages 150 and 151 may be drilled in header member 146 prior to connecting jamb piece 120 to header member 146. Alternatively, passages 134, 135, 150, and 151 may be drilled after jamb piece 120 is connected to header member 146. Further, it is to be understood that passages 134 and 150 are substantially aligned so as to provide a continuous first passage through apparatus 164 and that passages 135 and 151 are substantially aligned so as to provide a continuous second passage through apparatus 164. Finally, it is to be understood that protruding portion 122 protrudes inward from plate portions 124 and 126 into groove 148 toward the door opening adjacent to header member 146 in which doors 170 and 174 received. The inward protrusion of protruding portion 122 allows a greater portion of throws 173 and 177 to extend through jamb piece 120.

Header apparatus 164 preferably has a width from side edge 156 to side edge 158 of approximately four and one half inches (4 ½"). Further, apparatus 164 may be used in preexisting or new construction.

The method for securing a door jamb for a single door comprises the steps of removing the prior or preexisting lock side of the door jamb from the door jamb and connecting lock side apparatus 54, 54*a* or 54*b* to the jamb header of the door jamb. In the event apparatus 54 is utilized, the method further comprises the steps of connecting metal jamb member 10 to wooden lock side member 36 prior to connecting apparatus 54 to the jamb header and drilling passages 24 and 40 through member 10 and member 36, respectively. In the event apparatus 54*a* is utilized, the method further comprises the steps of inserting plate 92 into slot 78 prior to connecting apparatus 54*a* to the jamb header and drilling passages 94 and 80 through plate 92 and member 76, respectively. In the event apparatus 54*b* is utilized, the method further comprises the steps of connecting metal jamb member 98 to wooden lock side member 36 prior to connecting apparatus 54*b* to the jamb header and drilling passages 40 and 106 in member 36 and plate 98, respectively. The method for securing a door jamb may further comprise the step of connecting a keeper 70 to the respective apparatus 54, 54*a* or 54*b*.

The method for securing a door jamb for double doors comprises the steps of removing the prior or preexisting jamb header and connecting the apparatus 164 to the opposite sides of the door jamb. The method further comprises the steps of connecting the metal jamb piece 120 to the wooden header member 146 prior to connecting the apparatus 164 to the opposite sides of the door jamb. The method further comprises the steps of drilling passages 150 and 151 through member 146 and drilling passages 134 and 135 through piece 120.

While the door jamb security apparatus of the present invention has been described in connection with the preferred embodiment, it is not intended to limit the invention to the particular form set forth, but on the contrary, it is intended to cover such alternatives, modifications, and equivalents, as may be included within the spirit and scope of the invention as defined by the appended claims.

I claim:

1. A lock side of a door jamb, said lock side comprising a jamb member and a lock side member in mating engagement, said jamb member comprising a plate portion and a protruding portion, said plate portion being connected to an inside surface of said lock side member substantially flush therewith so that said lock side member is intermediate to said jamb member and a door opening defined by said door jamb and said protruding portion being received within a groove in said lock side member, whereby said protruding portion protrudes inward from said plate portion into said groove in said lock side member toward said door opening, said protruding portion having a bottom and a pair of sidewalls which are substantially perpendicular to said plate portion and said bottom, said bottom having a first passage therethrough and said lock side member having a second passage through a bottom of said groove, said protruding portion bottom being substantially flush with said bottom of said groove, said groove bottom being intermediate to said protruding portion bottom and said door opening, said first and second passages being substantially aligned and being adapted to receive a lock throw therein substantially perpendicular to said plate portion.

2. A lock side of a door jamb, as recited in claim 1, wherein said plate portion extends from each side of said protruding portion.

* * * * *